US011846105B2

(12) United States Patent
Matson

(10) Patent No.: US 11,846,105 B2
(45) Date of Patent: Dec. 19, 2023

(54) SIDING PANEL INSTALLATION

(71) Applicant: Russell Matson, Ralston, NE (US)

(72) Inventor: Russell Matson, Ralston, NE (US)

( * ) Notice: Subject to any disclaimer, the term of this patent is extended or adjusted under 35 U.S.C. 154(b) by 364 days.

(21) Appl. No.: 17/070,545

(22) Filed: Oct. 14, 2020

(65) Prior Publication Data

US 2021/0108421 A1 Apr. 15, 2021

Related U.S. Application Data

(60) Provisional application No. 62/914,739, filed on Oct. 14, 2019.

(51) Int. Cl.
*E04F 13/08* (2006.01)

(52) U.S. Cl.
CPC ..... *E04F 13/0803* (2013.01); *E04F 13/0805* (2013.01); *E04F 13/0828* (2013.01)

(58) Field of Classification Search
CPC . E04F 13/0805; E04F 19/064; E04F 13/0862; E04F 19/061; E04F 19/065; E04F 13/0803; E04F 13/0828
See application file for complete search history.

(56) References Cited

U.S. PATENT DOCUMENTS 2,188,090 A * 1/1940 Young ..... E04F 13/0841 52/459
2,245,785 A * 6/1941 Jentzer, Jr. ..... E04F 13/0803 52/506.08
4,545,162 A * 10/1985 Attaway ..... E04F 19/06 D25/119
4,660,339 A * 4/1987 Paz ..... E04F 13/0803 52/460
6,055,787 A * 5/2000 Gerhaher ..... E04F 13/0826 52/553
6,202,377 B1 * 3/2001 Krieger ..... E04F 13/0812 52/762
6,289,646 B1 * 9/2001 Watanabe ..... E04F 13/083 52/489.1

(Continued)

FOREIGN PATENT DOCUMENTS

AT 15995 U1 * 10/2018 ..... E04F 13/0828
CA 2593835 A1 * 1/2008 ..... E04F 13/0803

(Continued)

*Primary Examiner* — Brian D Mattei
*Assistant Examiner* — Charissa Ahmad
(74) *Attorney, Agent, or Firm* — Erik M. Antonson; Advent, LLP

(57) ABSTRACT

A siding panel installation system can include a support tray channel with a first leg and a second leg opposite the first leg, where the second leg of the support tray channel is offset from a mounting face plane of the first leg by a support tray connecting the first leg and the second leg together. The siding panel installation system can also include an inside mounting clip with an attachment leg and a support channel spaced apart from the attachment leg and offset from a mounting face plane of the attachment leg, where the support channel of the inside mounting clip is configured to receive the first leg of the support tray channel. The siding panel installation system can include an outside corner clip with an attachment leg and a support channel spaced apart from the attachment leg and offset from a mounting face plane of the attachment leg.

17 Claims, 23 Drawing Sheets

(56) References Cited

U.S. PATENT DOCUMENTS

| | | | | |
|---|---|---|---|---|
| 6,430,883 | B1 * | 8/2002 | Paz | A47F 5/105 52/27 |
| 8,127,507 | B1 * | 3/2012 | Bilge | E04F 13/0814 52/235 |
| 8,196,367 | B2 * | 6/2012 | De Bray | E04F 13/0864 52/549 |
| 8,240,099 | B2 * | 8/2012 | Hummel, III | E04F 13/081 52/235 |
| 8,347,577 | B2 * | 1/2013 | Aboukhalil | E04F 13/16 52/302.1 |
| 8,839,582 | B2 * | 9/2014 | Aboukhalil | E04F 19/062 52/460 |
| 8,938,927 | B1 * | 1/2015 | Bragg | E04F 13/0878 52/715 |
| 9,080,331 | B2 * | 7/2015 | Aboukhalil | E04F 13/0816 |
| 9,506,252 | B2 * | 11/2016 | Molteni | A47B 96/067 |
| 9,850,666 | B2 * | 12/2017 | Libreiro | E04F 13/0816 |
| 9,874,026 | B2 * | 1/2018 | Bilge | E04F 13/0891 |
| 9,896,849 | B1 * | 2/2018 | Aboukhalil | E04F 13/0803 |
| 10,612,247 | B2 * | 4/2020 | Simonsen | E04F 13/0819 |
| 10,697,183 | B1 * | 6/2020 | Ferguson | E04F 13/083 |
| 11,261,599 | B2 * | 3/2022 | Singh | E04B 1/6803 |
| 2009/0241451 | A1 * | 10/2009 | Griffiths | E04F 13/0889 52/309.4 |
| 2012/0255249 | A1 * | 10/2012 | Singh | E04F 19/062 52/302.1 |
| 2012/0317909 | A1 * | 12/2012 | MacKenzie | E04B 1/7076 52/698 |
| 2016/0281351 | A1 * | 9/2016 | Singh | E04B 1/64 |
| 2018/0328027 | A1 * | 11/2018 | Singh | E04B 1/6803 |
| 2019/0078335 | A1 * | 3/2019 | Kaligian, II | E04B 1/84 |
| 2021/0108421 | A1 * | 4/2021 | Matson | E04F 13/0803 |
| 2021/0254347 | A1 * | 8/2021 | Nelson | E04B 1/7629 |
| 2022/0120097 | A1 * | 4/2022 | Mineo | E04F 19/064 |

FOREIGN PATENT DOCUMENTS

| | | | | |
|---|---|---|---|---|
| CA | 2909961 | A1 * | 9/2016 | E04B 1/40 |
| CH | 679874 | A5 * | 4/1992 | E04F 13/0814 |
| DE | 2410074 | A1 * | 9/1975 | E04F 13/0803 |
| DE | 3239161 | A * | 5/1983 | E04F 13/0803 |
| DE | 3702125 | A1 * | 8/1988 | E04F 13/0828 |
| DE | 10205623 | A1 * | 9/2003 | E04F 13/0805 |
| DE | 202010008983 | U1 * | 2/2011 | E04F 13/0805 |
| DE | 102010046376 | A1 * | 3/2012 | E04F 13/0805 |
| EP | 100431 | A * | 2/1984 | E04F 13/0803 |
| EP | 0107739 | A1 * | 5/1984 | E04F 13/0803 |
| EP | 180837 | A * | 5/1986 | E04B 2/90 |
| EP | 0246391 | A1 * | 11/1987 | A47B 96/067 |
| EP | 0430224 | B1 * | 4/1993 | E04F 13/0803 |
| EP | 959197 | A1 * | 11/1999 | A47B 96/067 |
| EP | 1878847 | A2 * | 1/2008 | E04F 13/0812 |
| EP | 2186966 | A2 * | 5/2010 | E04F 13/0805 |
| EP | 2982812 | A1 * | 2/2016 | E04F 13/0814 |
| EP | 3450649 | B1 * | 3/2020 | E04F 13/0828 |
| KR | 100885400 | B1 * | 2/2009 | E04F 13/0805 |
| KR | 1410499 | B1 * | 6/2014 | E04F 13/0805 |
| KR | 2020104535 | A * | 9/2020 | E04F 13/0805 |
| WO | WO-9308347 | A1 * | 4/1993 | E04F 13/0805 |
| WO | WO-9323637 | A1 * | 11/1993 | E04B 2/86 |
| WO | WO-9811312 | A1 * | 3/1998 | E04F 13/0816 |
| WO | WO-2010012061 | A1 * | 2/2010 | E04F 13/0805 |
| WO | WO-2018234772 | A1 * | 12/2018 | E04B 1/82 |
| WO | WO-2019128094 | A1 * | 7/2019 | E04F 13/0803 |
| WO | WO-2021168104 | A1 * | 8/2021 | E04F 13/0803 |

* cited by examiner

SIDING PANEL INSTALLATION

CROSS-REFERENCE TO RELATED APPLICATIONS

The present application claims the benefit under 35 U.S.C. § 119(e) of U.S. Provisional Application Ser. No. 62/914,739, filed Oct. 14, 2019, and titled "SIDING PANEL INSTALLATION," which is herein incorporated by reference in its entirety.

BACKGROUND

Siding, also referred to as wall cladding, is material attached to an exterior side or wall of a house or another type of building or structure. Siding material is typically weather-resistant and is generally formed using pieces of material that are smaller than the wall they cover (e.g., to account for expansion and contraction of materials due to moisture and/or temperature changes and the like).

DRAWINGS

The Detailed Description is described with reference to the accompanying figures. The use of the same reference characters in different instances in the description and the figures may indicate similar or identical items.

Figure 5:
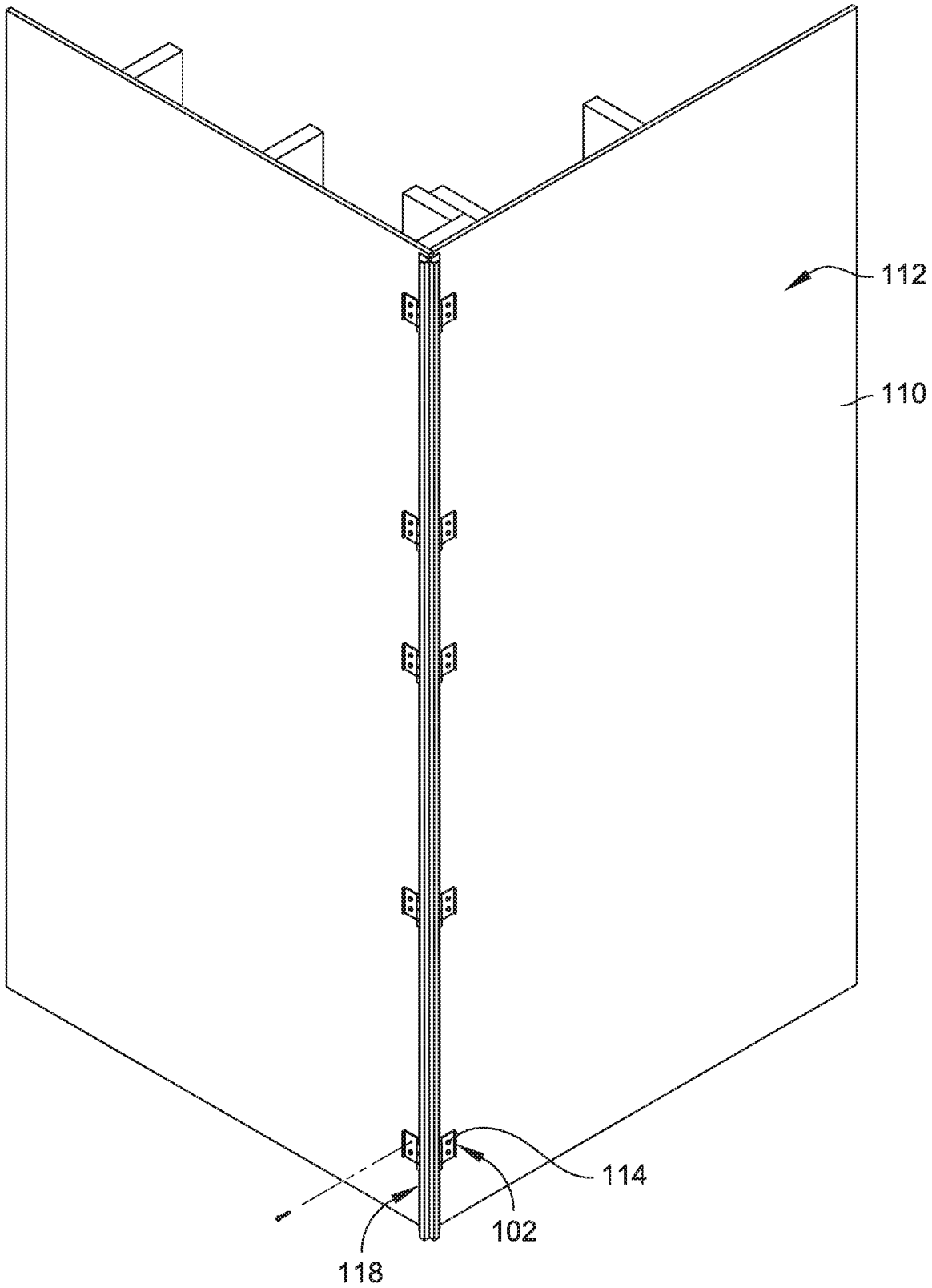
FIG. 5 is a perspective view illustrating an exterior wall with outside corner clips, such as the outside corner clip extrusion illustrated in FIGS. 2A and 2B, and an outside corner channel, such as the outside corner channel extrusion illustrated in FIGS. 3A and 3B, attached thereto in accordance with example embodiments of the present disclosure.
Figure 6:
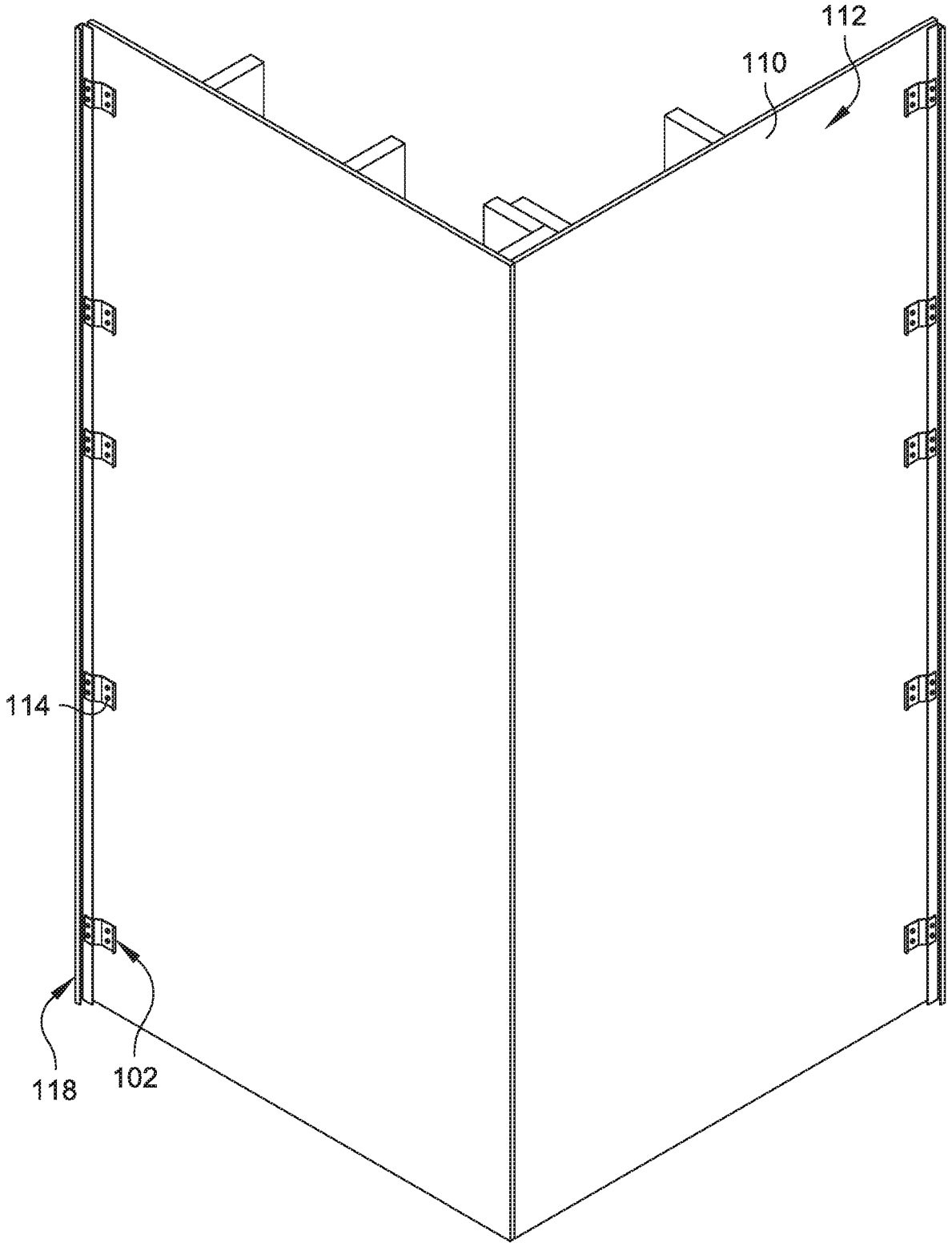
FIG. 6 is another perspective view illustrating an exterior wall with outside corner clips, such as the outside corner clip extrusion illustrated in FIGS. 2A and 2B, and an outside corner channel, such as the outside corner channel extrusion illustrated in FIGS. 4A and 4B, attached thereto in accordance with example embodiments of the present disclosure.
Figure 7A:
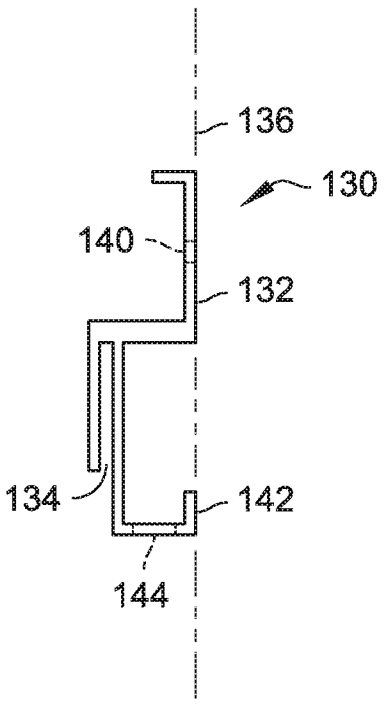
FIG. 7A is an end view illustrating an inside mounting clip extrusion in accordance with example embodiments of the present disclosure.
Figure 7B:
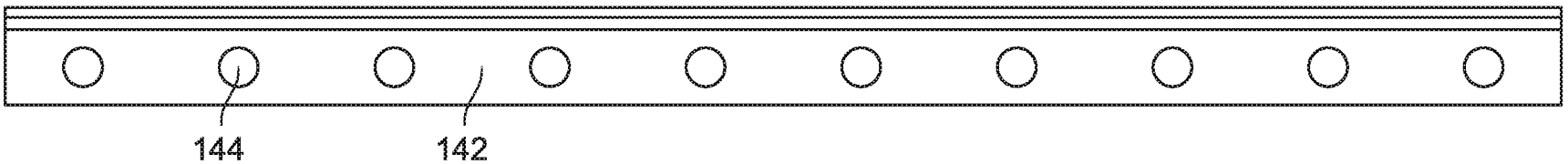
FIG. 7B is a partial bottom view of the inside mounting clip extrusion illustrated in FIG. 7A.
Figure 7C:
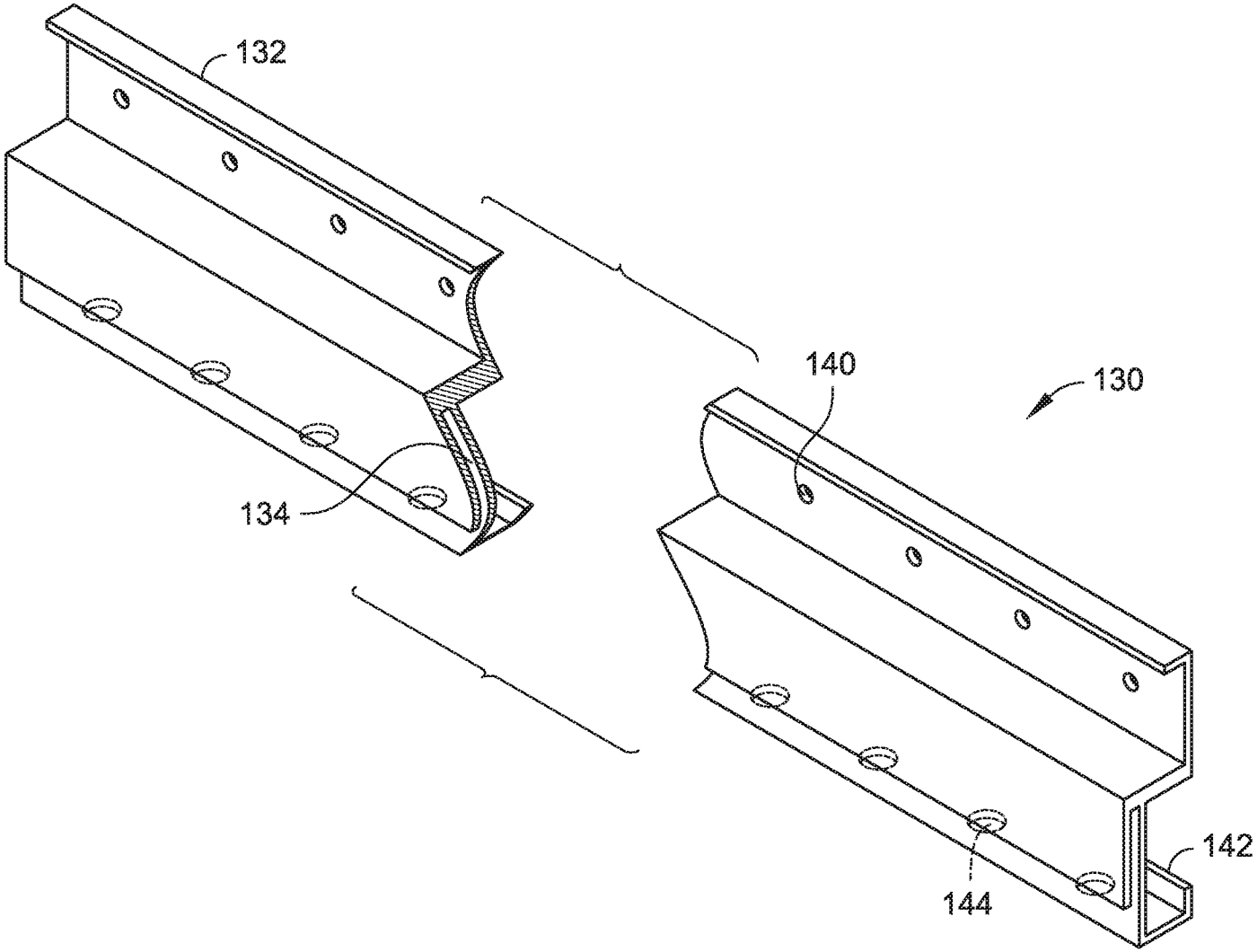
FIG. 7C is a partial isometric view of the inside mounting clip extrusion illustrated in FIG. 7A.
Figure 8A:
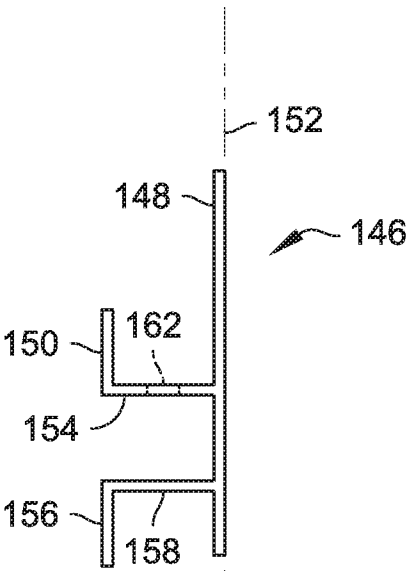
FIG. 8A is an end view illustrating a support tray channel extrusion in accordance with example embodiments of the present disclosure.
Figure 8B:
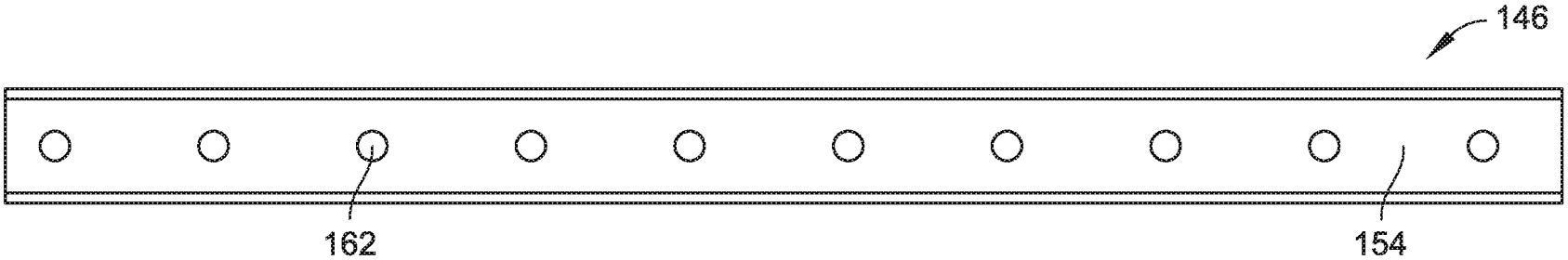
FIG. 8B is a partial top view of the support tray channel extrusion illustrated in FIG. 8A.
Figure 8C:
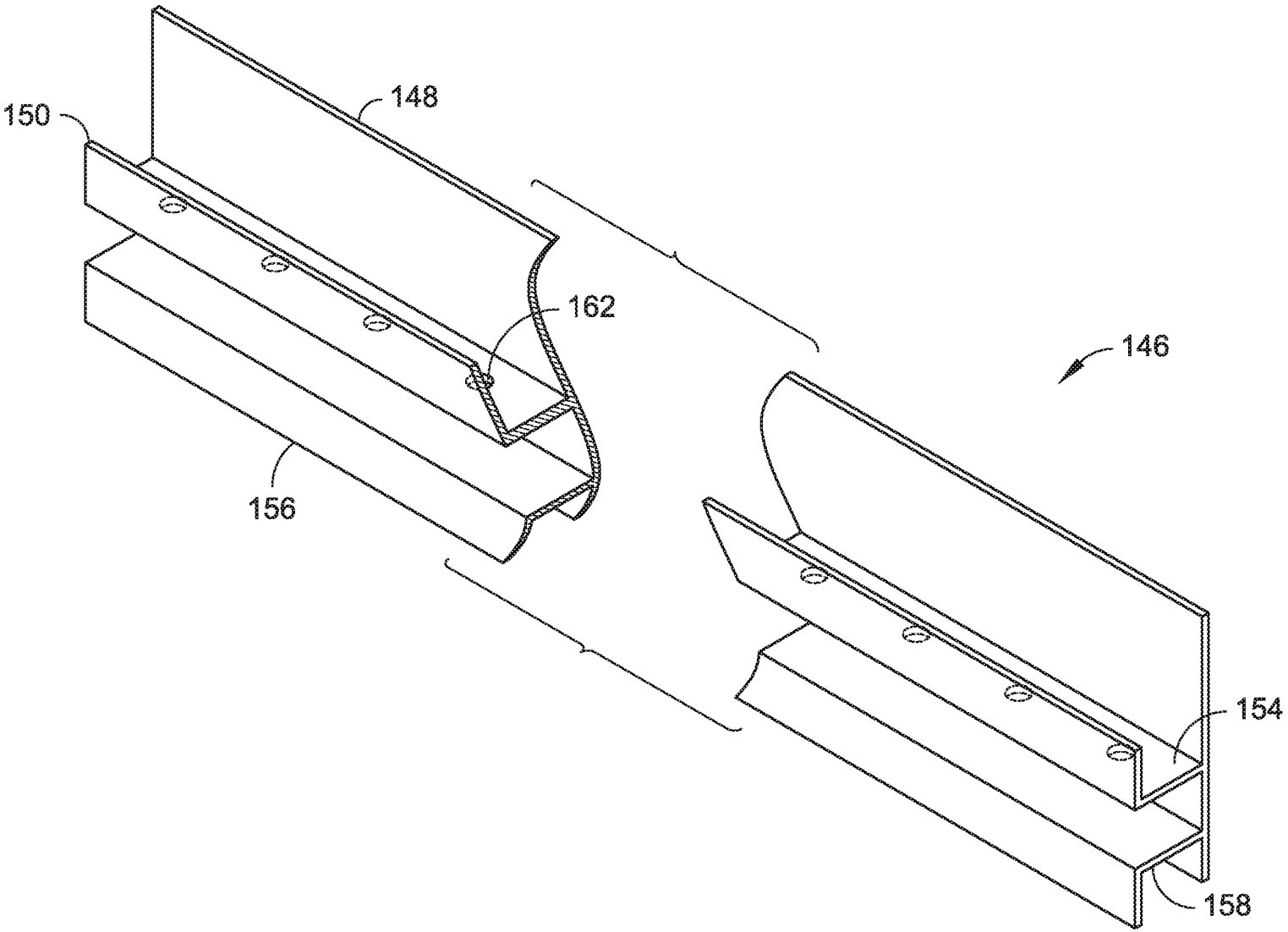
FIG. 8C is a partial isometric view of the support tray channel extrusion illustrated in FIG. 8A.
Figure 9:
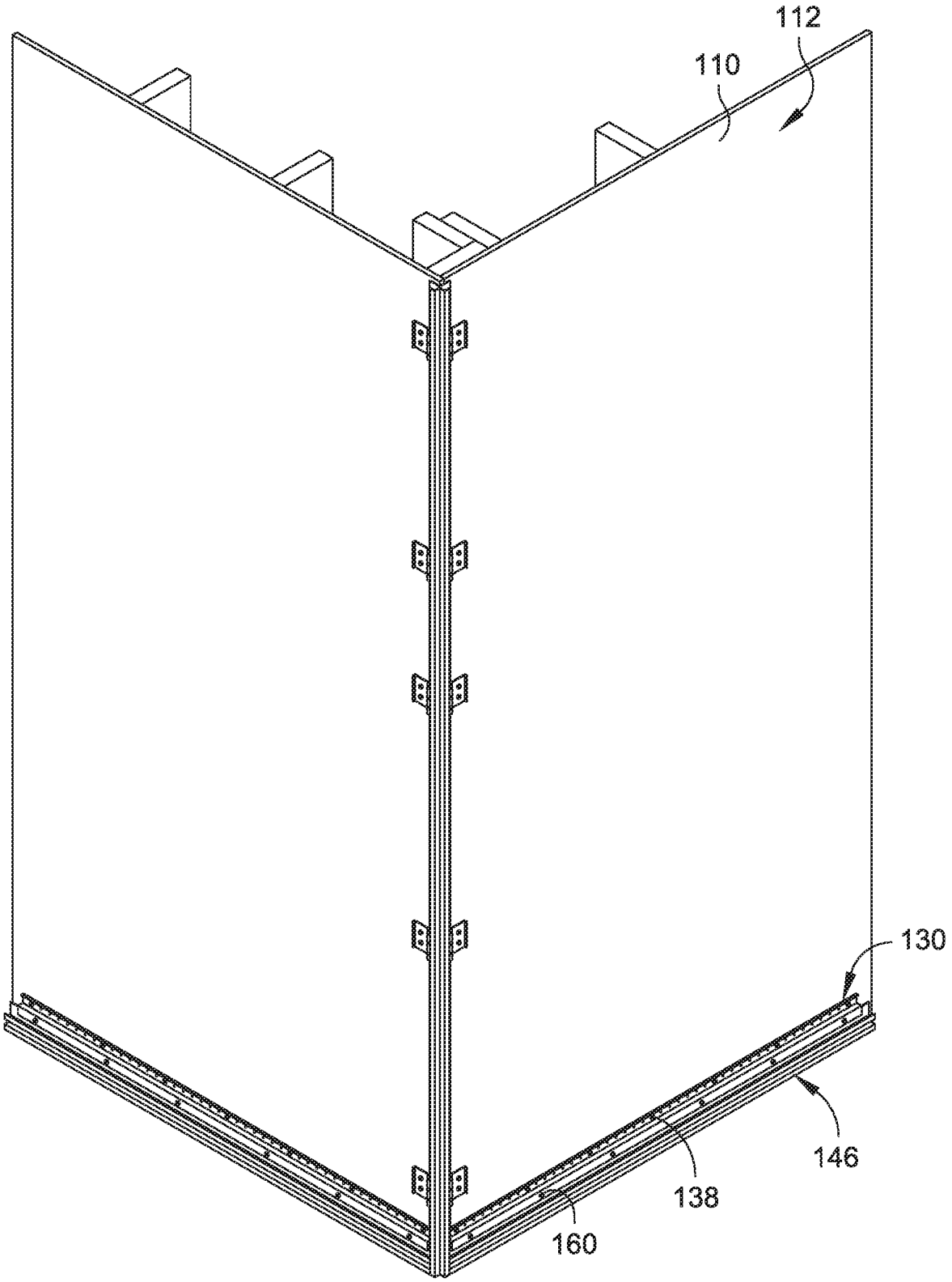

FIG. 9 is a perspective view illustrating an exterior wall with outside corner clips and an outside corner channel, such as the exterior wall illustrated in FIGS. 5 and 6, further including an inside mounting clip, such as the inside mounting clip extrusion illustrated in FIGS. 7A through 7C, and a support tray channel, such as the support tray channel extrusion illustrated in FIGS. 8A through 8C, attached thereto in accordance with example embodiments of the present disclosure.

Figure 10:
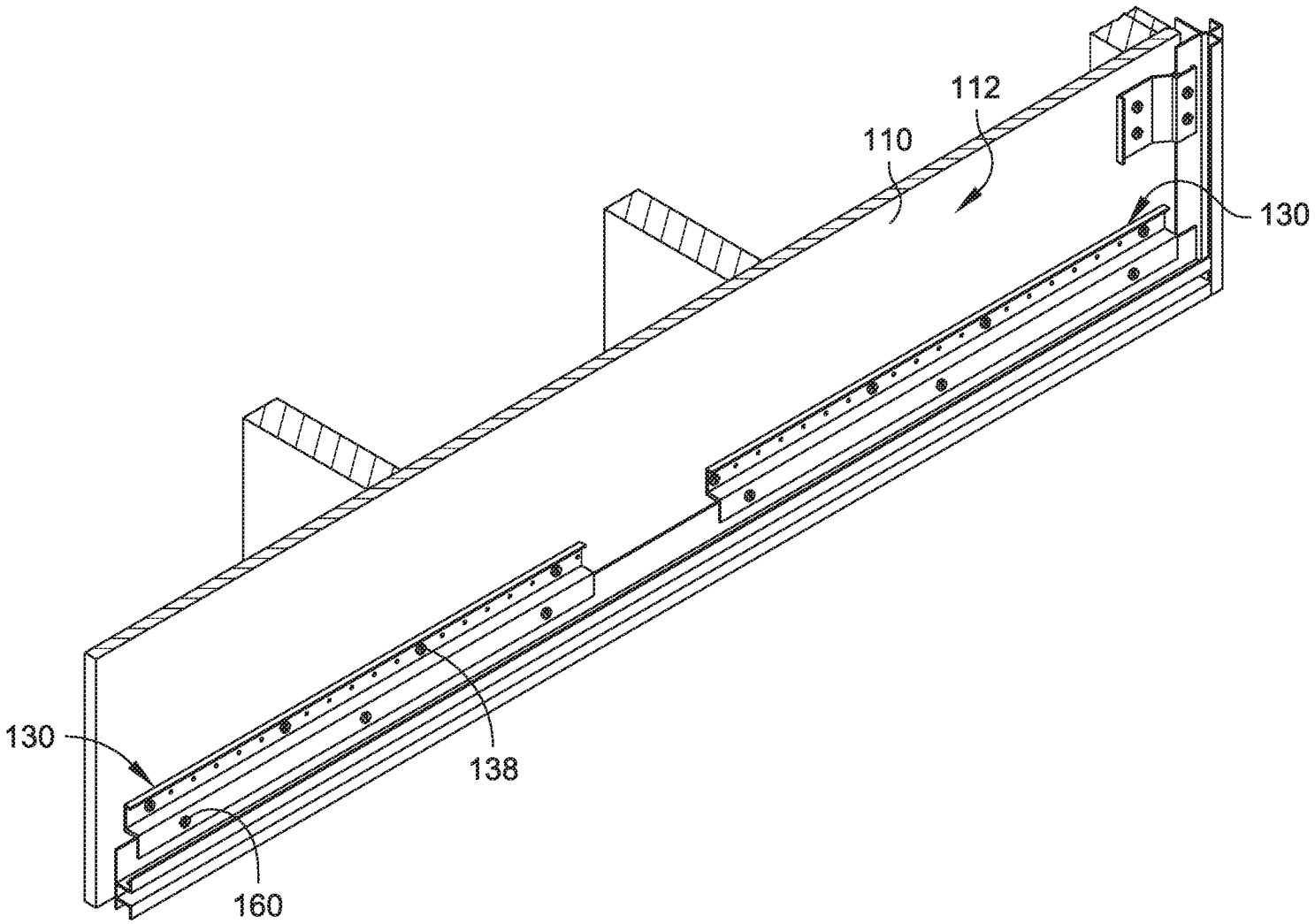

FIG. 10 is another perspective view illustrating an exterior wall with outside corner clips and an outside corner channel, such as the exterior wall illustrated in FIGS. 5 and 6, further including inside mounting clips, such as the inside mounting clip extrusion illustrated in FIGS. 7A through 7C, and a support tray channel, such as the support tray channel extrusion illustrated in FIGS. 8A through 8C, attached thereto in accordance with example embodiments of the present disclosure.

Figure 11A:
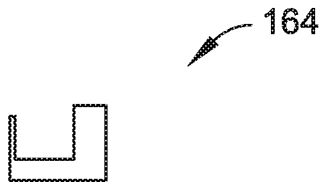

FIG. 11A is an end view illustrating a panel spacer in accordance with example embodiments of the present disclosure.

Figure 11B:
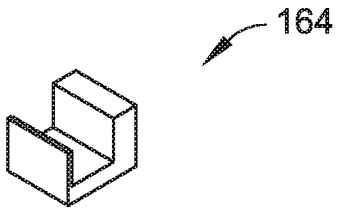

FIG. 11B is an isometric view of the panel spacer illustrated in FIG. 11A.

Figure 12:
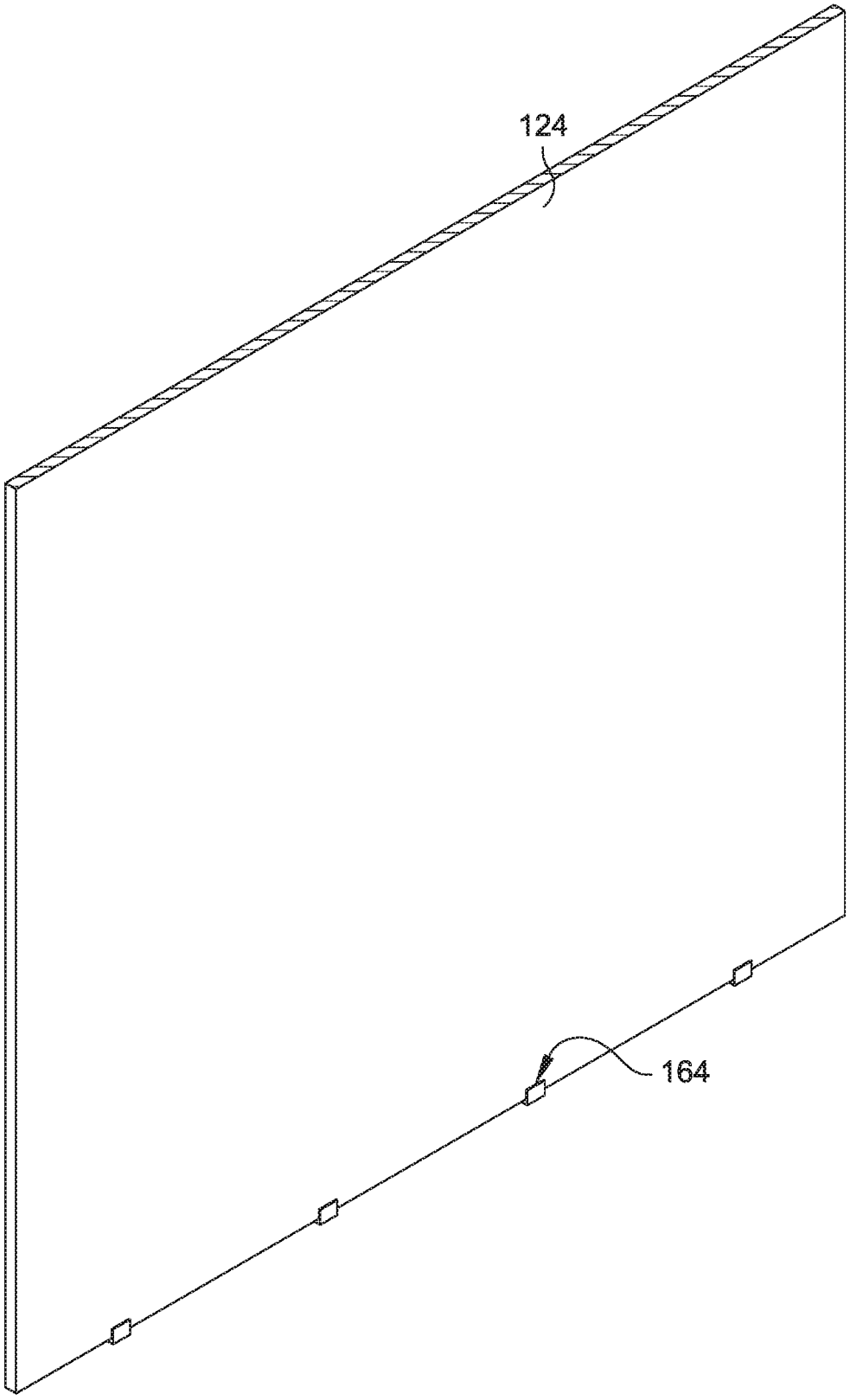

FIG. 12 is a perspective view illustrating a siding panel and panel spacers, such as the panel spacer illustrated in FIGS. 11A and 11B, in accordance with example embodiments of the present disclosure.

Figure 13A:
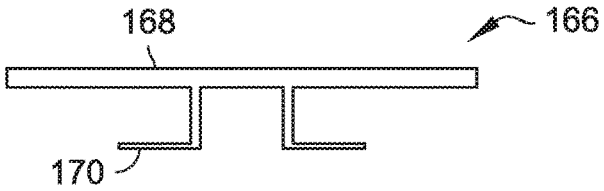

FIG. 13A is an end view illustrating a panel spacer channel extrusion in accordance with example embodiments of the present disclosure.

Figure 13B:
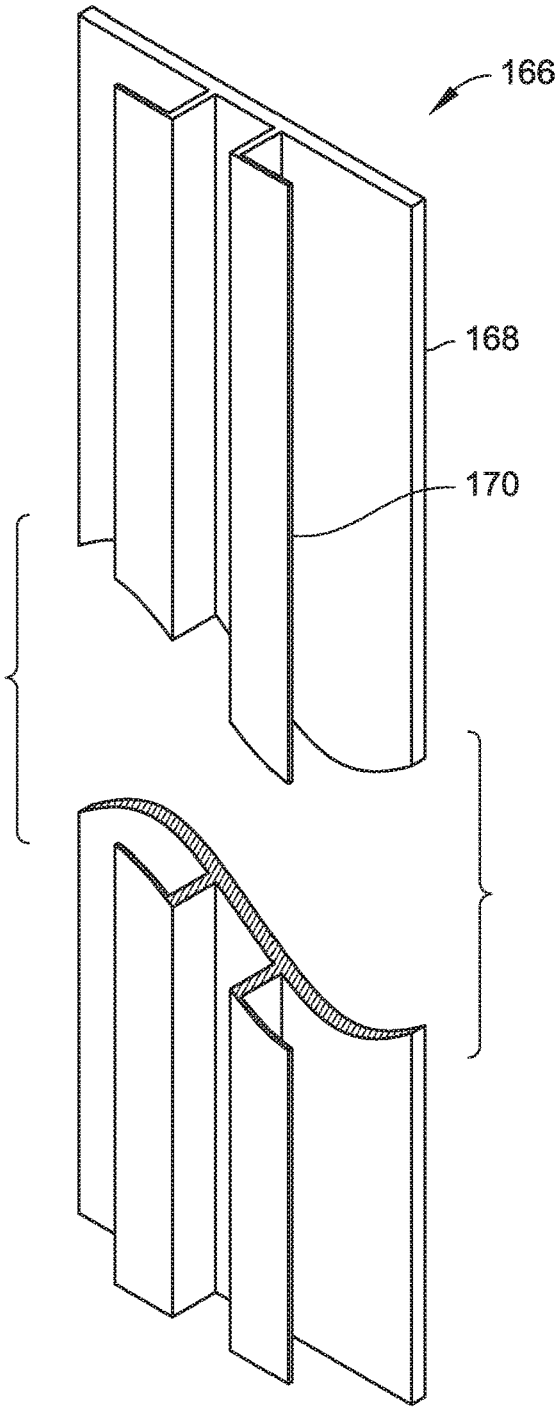

FIG. 13B is a partial isometric view of the panel spacer channel extrusion illustrated in FIG. 13A.

Figure 14:
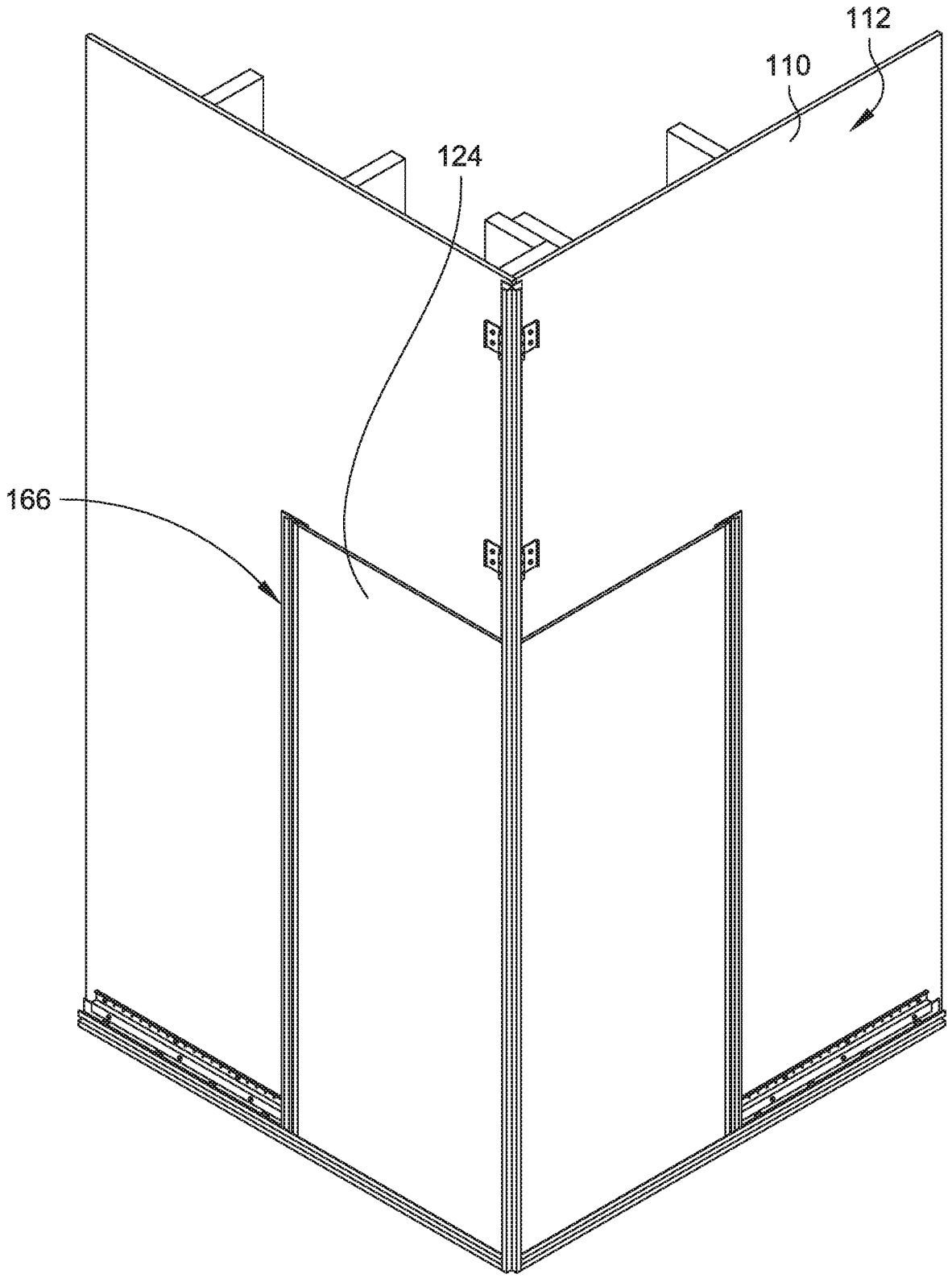

FIG. 14 is a perspective view illustrating an exterior wall with outside corner clips, an outside corner channel, inside mounting clips, and a support tray channel, such as the exterior wall illustrated in FIGS. 9 and 10, further including the siding panel and panel spacers illustrated in FIG. 12, and a panel spacer channel, such as the panel spacer channel extrusion illustrated in FIGS. 13A and 13B, attached thereto in accordance with example embodiments of the present disclosure.

Figure 15A:
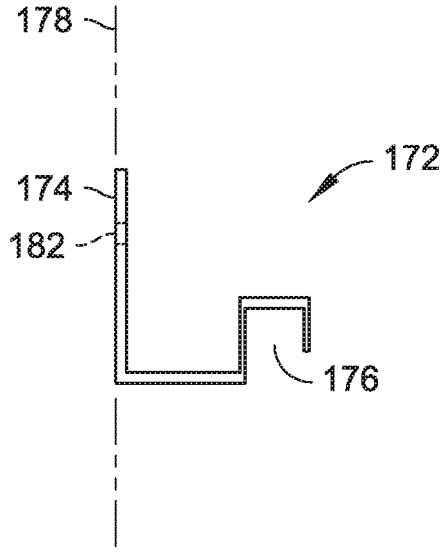

FIG. 15A is an end view illustrating a top panel clip in accordance with example embodiments of the present disclosure.

Figure 15B:
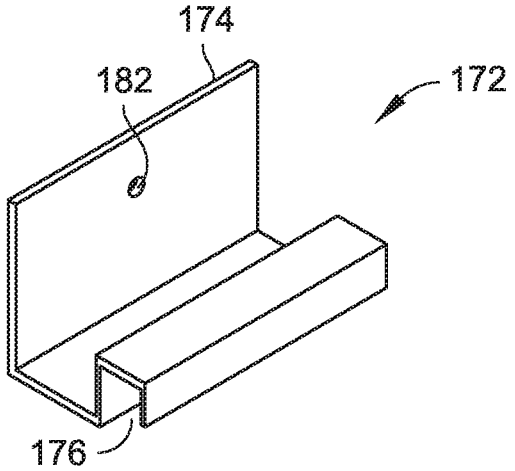

FIG. 15B is an isometric view of the top panel clip illustrated in FIG. 15A.

Figure 16A:
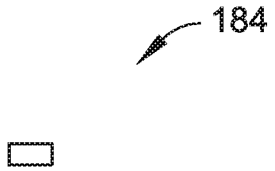

FIG. 16A is an end view illustrating a compression strip in accordance with example embodiments of the present disclosure.

FIG. 16 B is an isometric view of the compression strip illustrated in FIG. 16A.

Figure 16B:
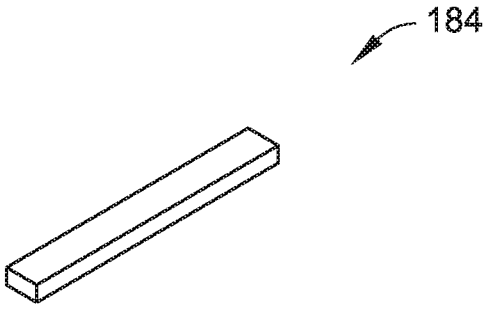
Figure 17:
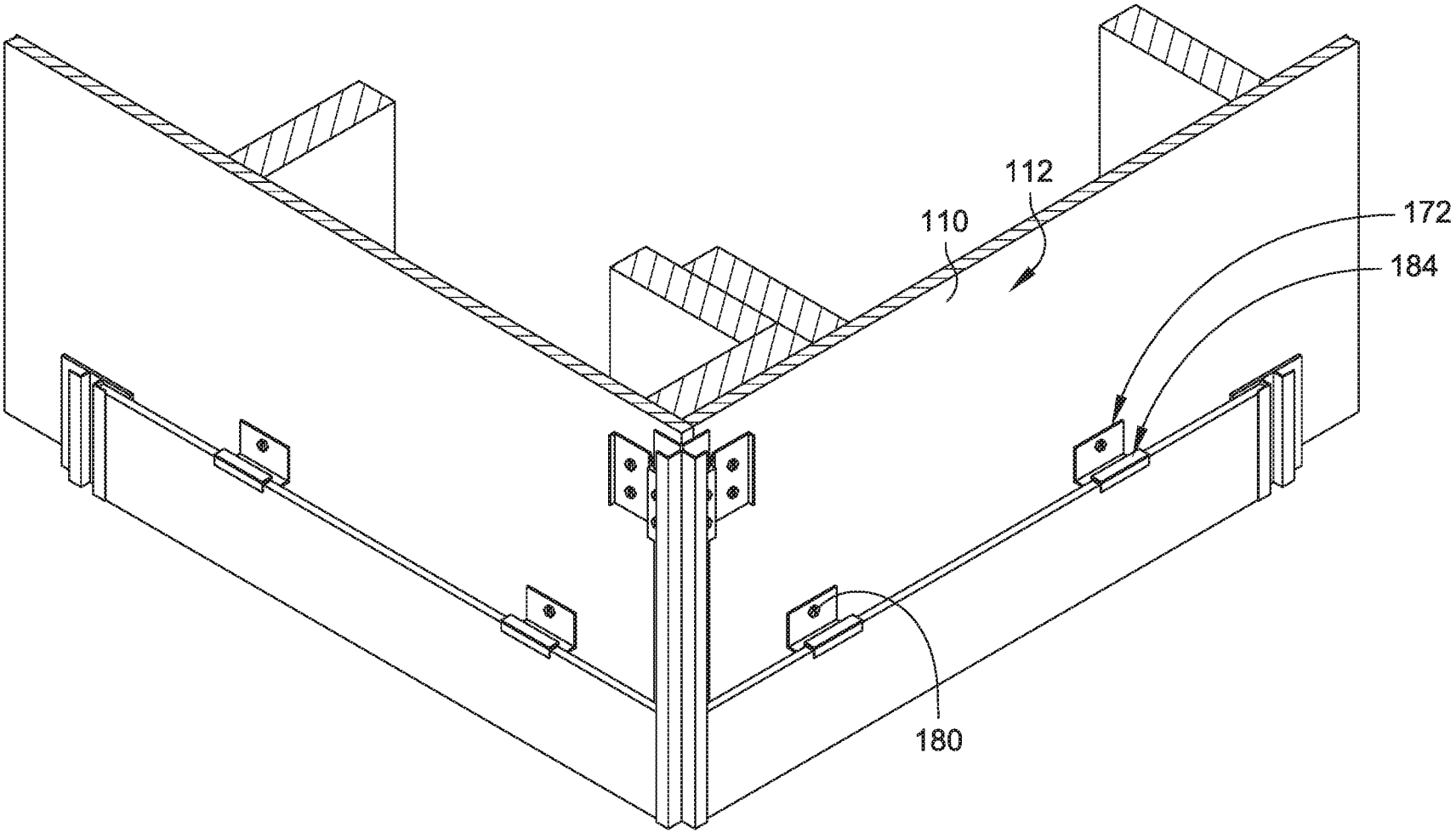

FIG. 17 is a perspective view illustrating an exterior wall with outside corner clips, an outside corner channel, inside mounting clips, a support tray channel, a siding panel, panel spacers, and a panel spacer channel, such as the exterior wall illustrated in FIG. 14, further including top panel clips, such as the top panel clip illustrated in FIGS. 15A and 15B, and compression strips, such as the compression strip illustrated in FIGS. 16A and 16B, attached thereto in accordance with example embodiments of the present disclosure.

Figure 18:
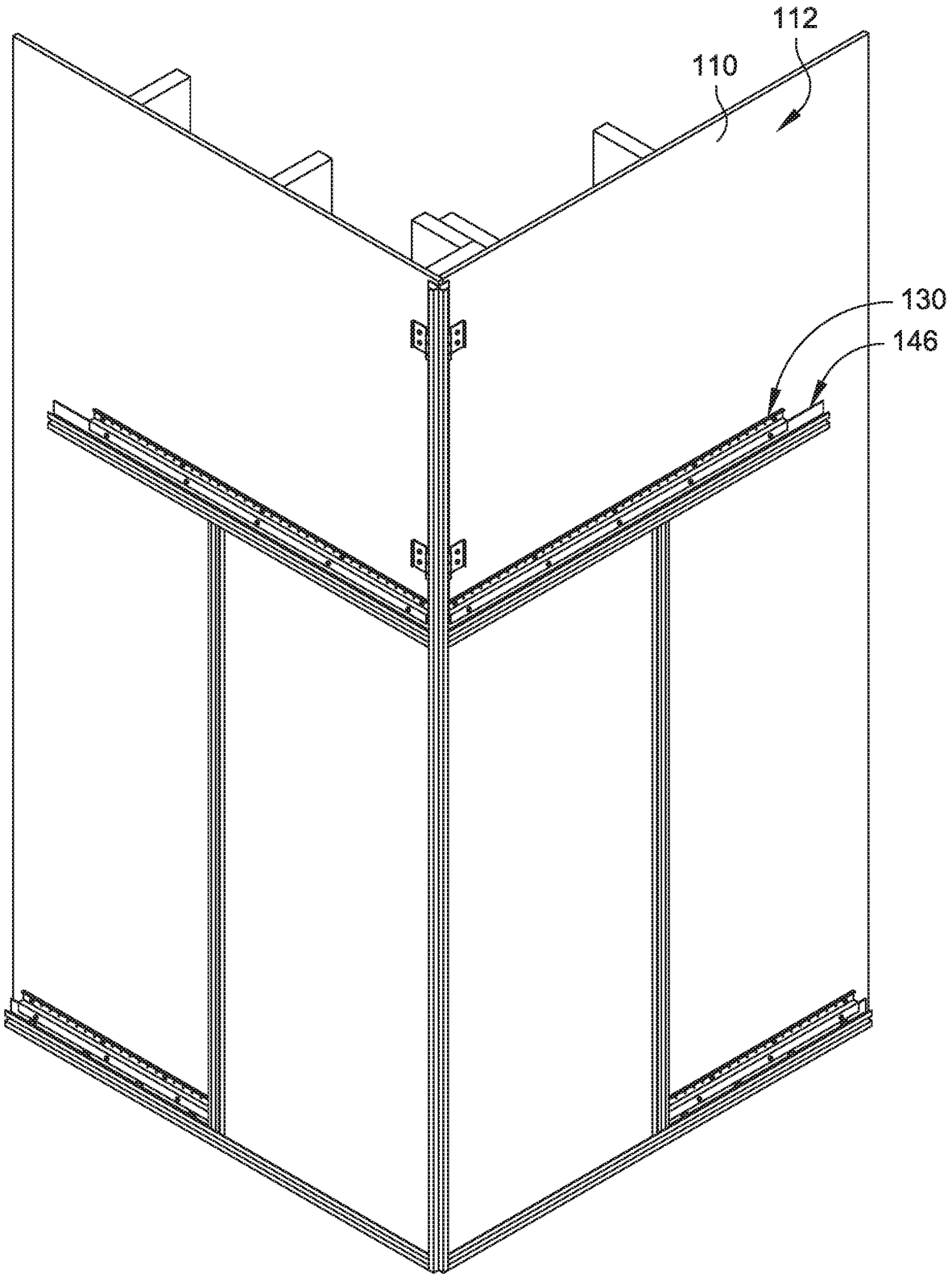

FIG. 18 is a perspective view illustrating an exterior wall with outside corner clips, an outside corner channel, inside mounting clips, a support tray channel, a siding panel, panel spacers, a panel spacer channel, top panel clips, and compression strips, such as the exterior wall illustrated in FIG. 17, further including another inside mounting clip, such as the inside mounting clip extrusion illustrated in FIGS. 7A through 7C, and another support tray channel, such as the support tray channel extrusion illustrated in FIGS. 8A through 8C, attached thereto in accordance with example embodiments of the present disclosure.

Figure 19A:
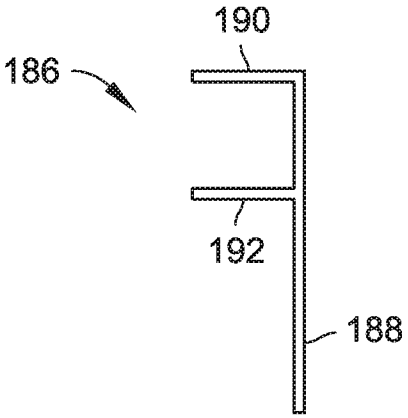

FIG. 19A is an end view illustrating a back soffit termination channel extrusion in accordance with example embodiments of the present disclosure.

Figure 19B:
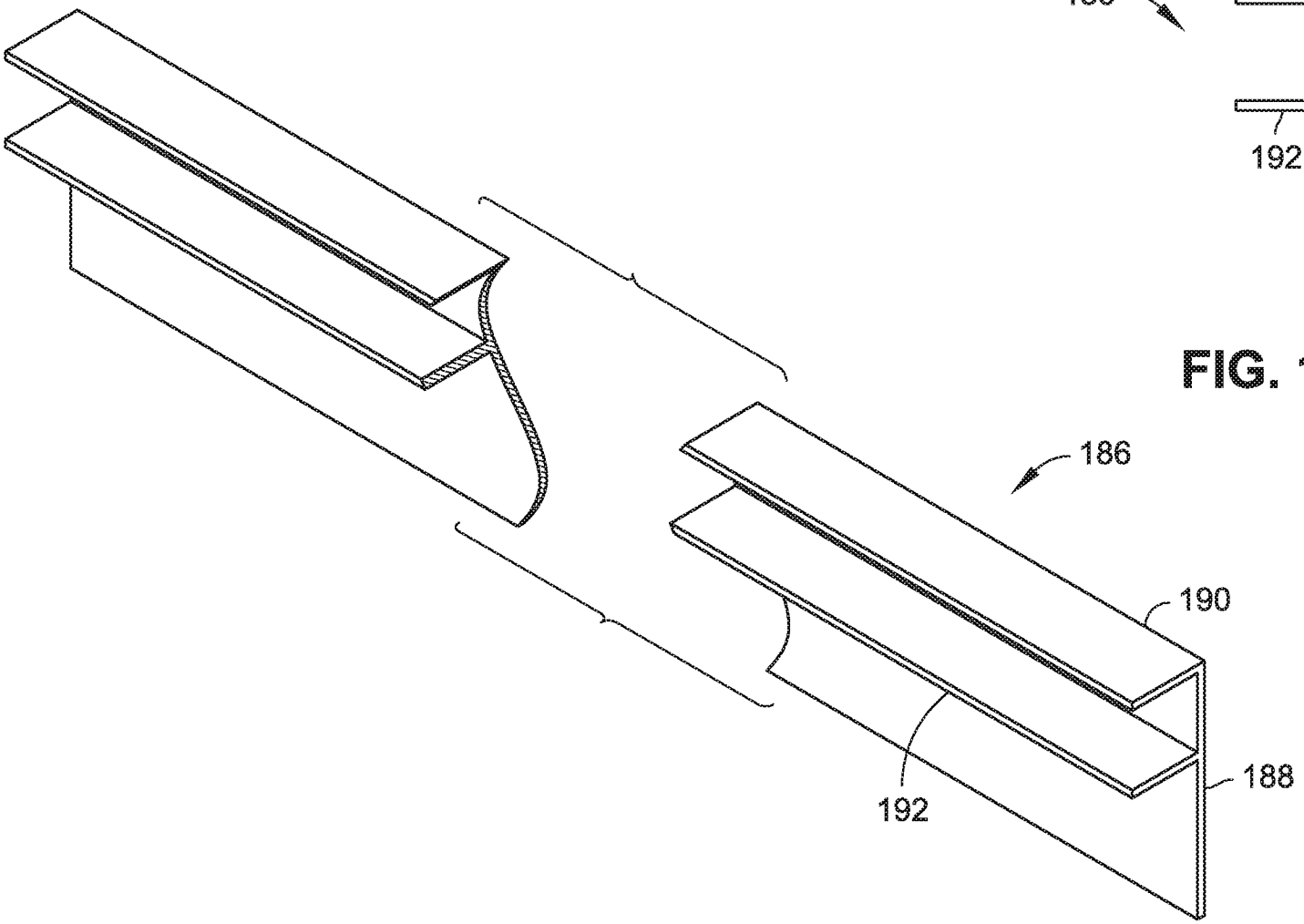

FIG. 19B is a partial isometric view of the back soffit termination channel extrusion illustrated in FIG. 19A.

Figure 20A:
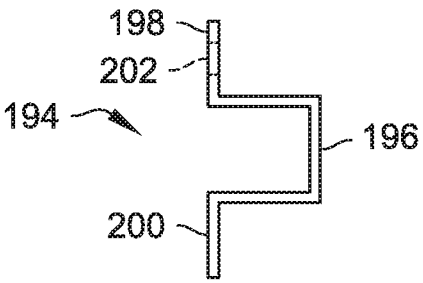

FIG. 20A is an end view illustrating a front soffit termination channel extrusion in accordance with example embodiments of the present disclosure.

Figure 20B:
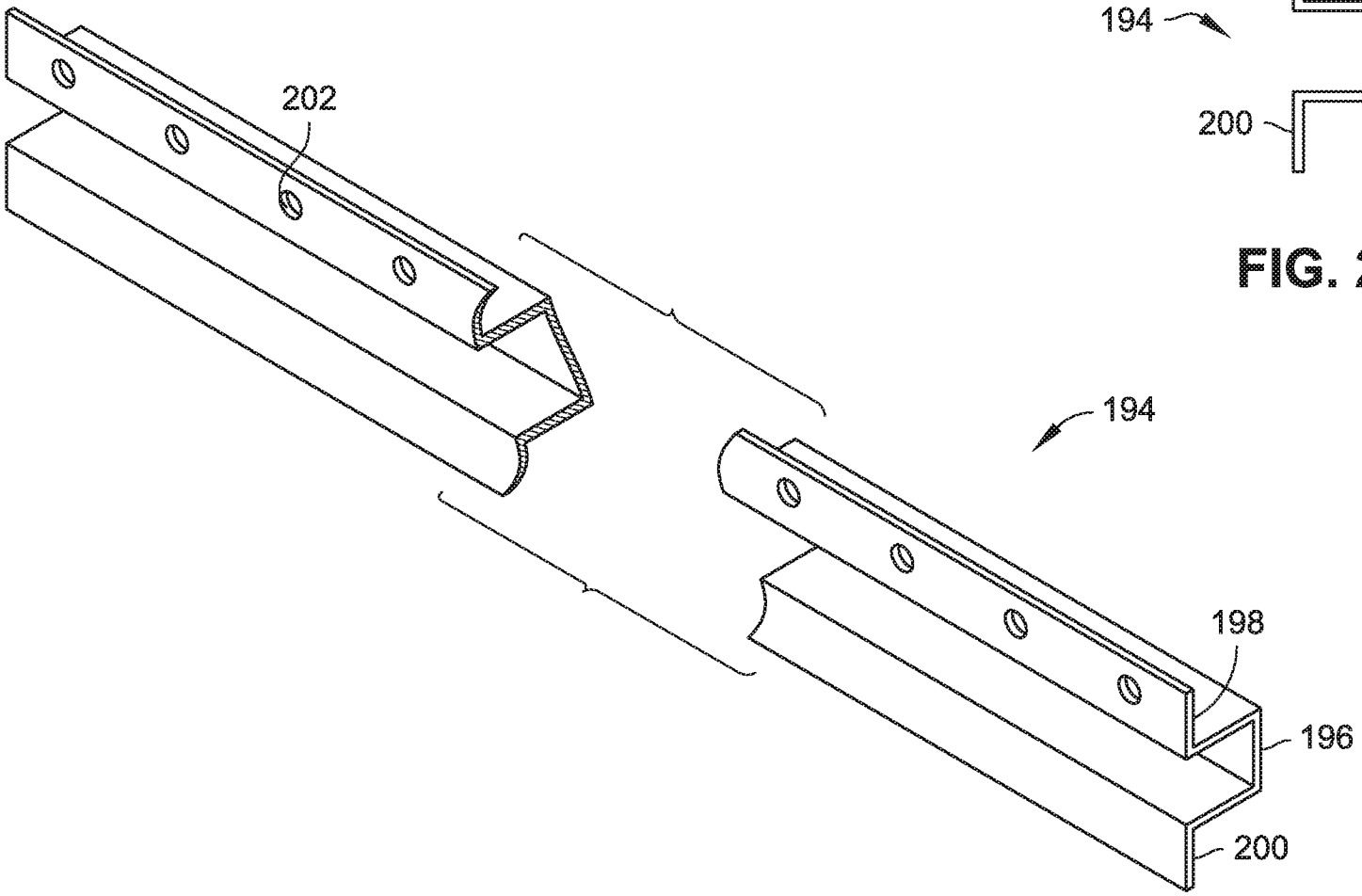

FIG. 20B is a partial isometric view of the front soffit termination channel extrusion illustrated in FIG. 20A.

Figure 21:
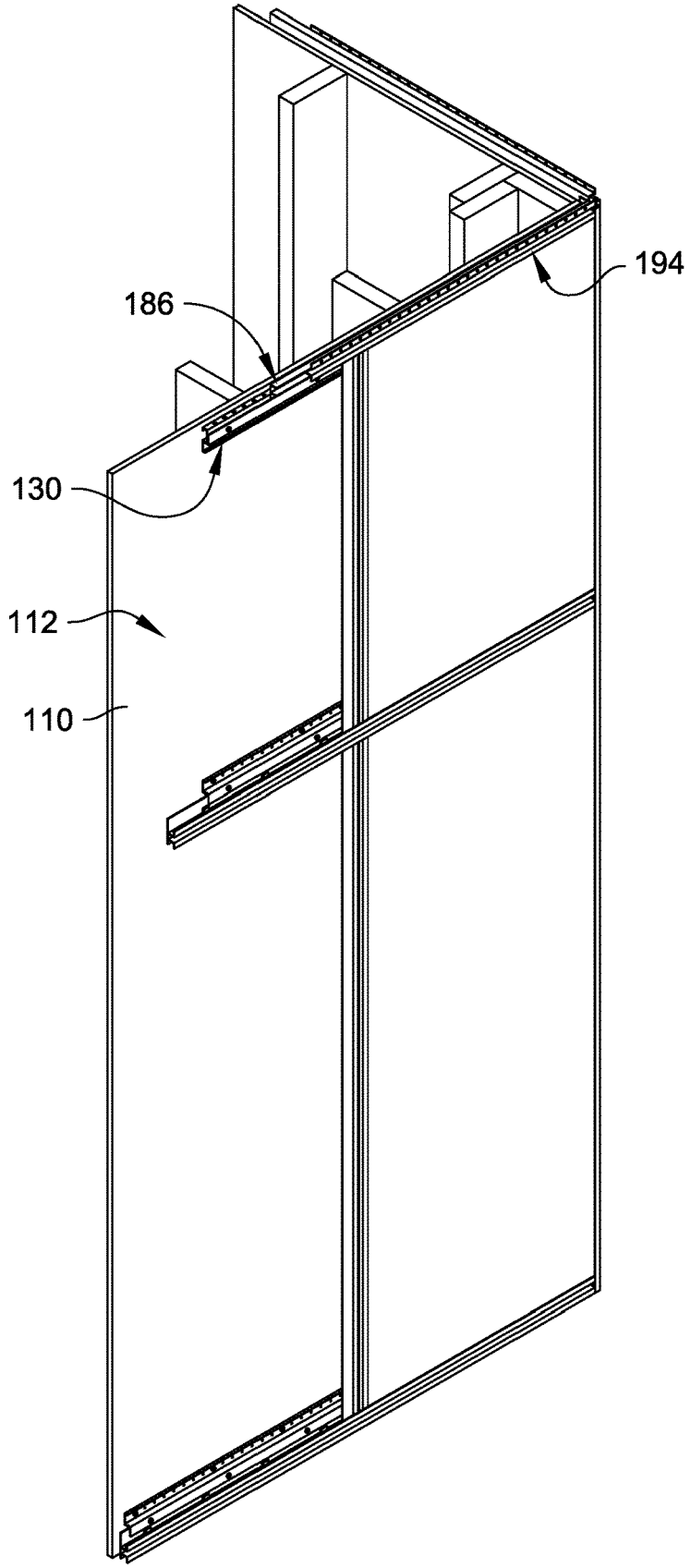

FIG. 21 is a perspective view illustrating an exterior wall with outside corner clips, an outside corner channel, inside mounting clips, a support tray channel, a siding panel, panel spacers, a panel spacer channel, top panel clips, and compression strips, such as the exterior wall illustrated in FIG. 17, further including another inside mounting clip, such as the inside mounting clip extrusion illustrated in FIGS. 7A through 7C, a back soffit termination channel, such as the back soffit termination channel extrusion illustrated in FIGS. 19A and 19B, and a front soffit termination channel, such as the front soffit termination channel extrusion illustrated in FIGS. 20A and 20B, attached thereto in accordance with example embodiments of the present disclosure.

DETAILED DESCRIPTION

Figure 1:
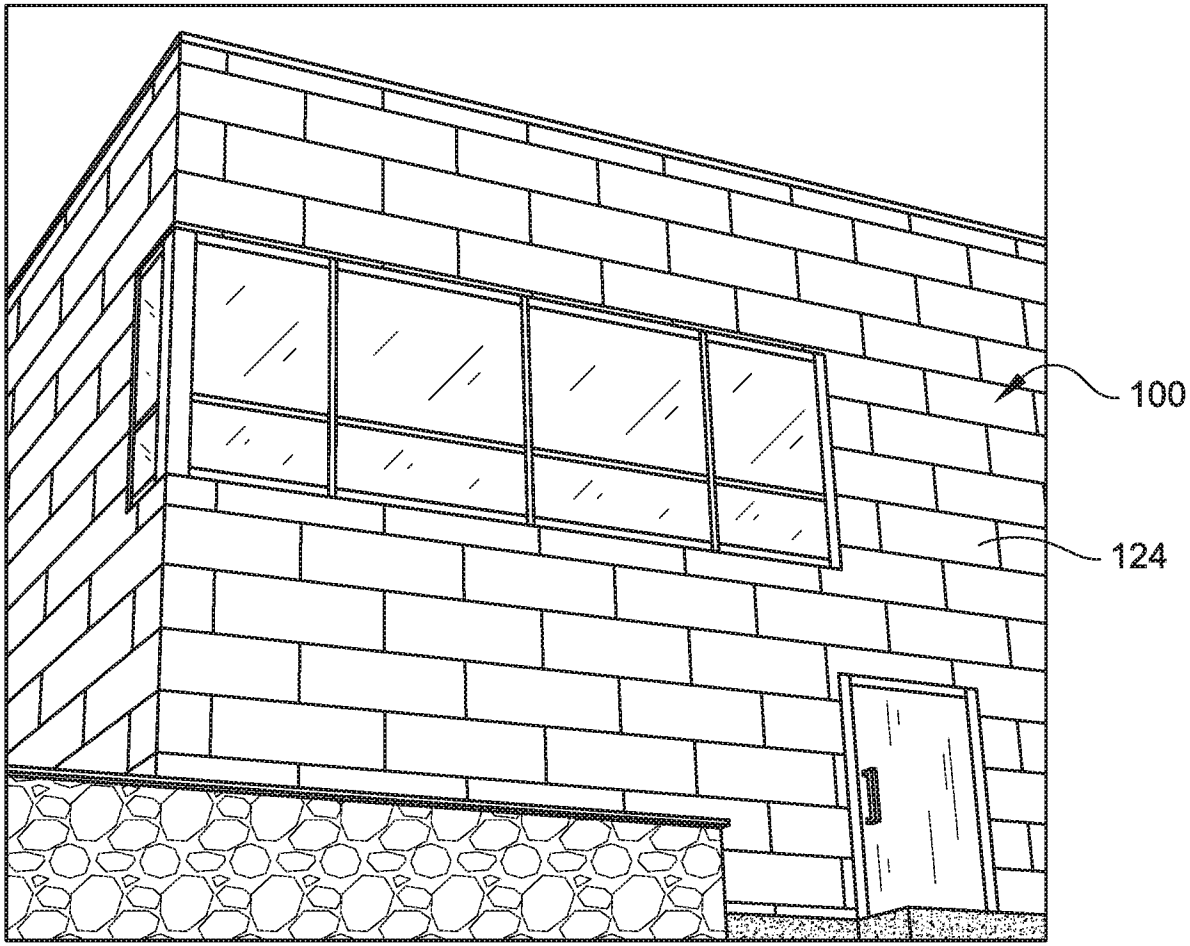
FIG. 1 is an environmental view illustrating a siding panel installation system installed on a building in accordance with example embodiments of the present disclosure.
Figure 2A:
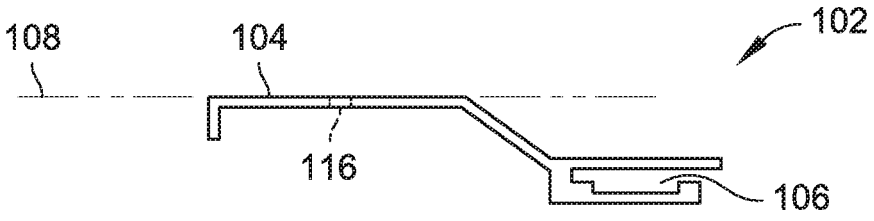
FIG. 2A is an end view illustrating an outside corner clip extrusion in accordance with example embodiments of the present disclosure.
Figure 2B:
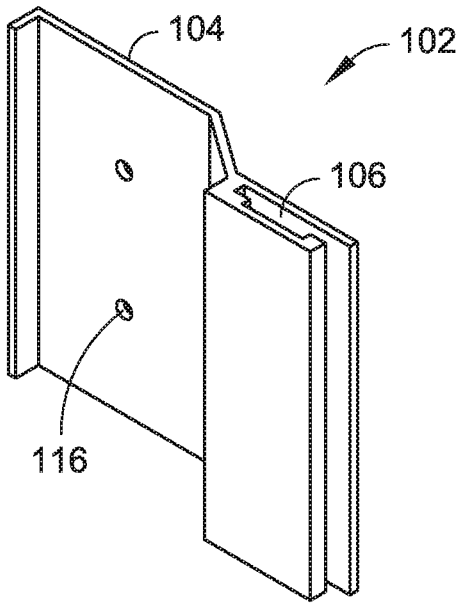
FIG. 2B is an isometric view of the outside corner clip extrusion illustrated in FIG. 2A.
Figure 3A:
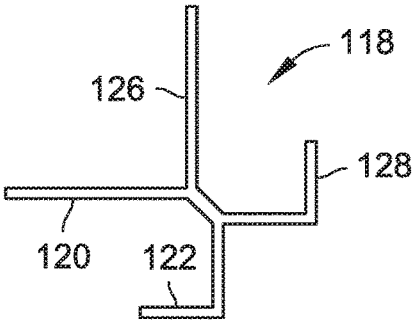
FIG. 3A is an end view illustrating an outside corner channel extrusion in accordance with example embodiments of the present disclosure.
Figure 3B:
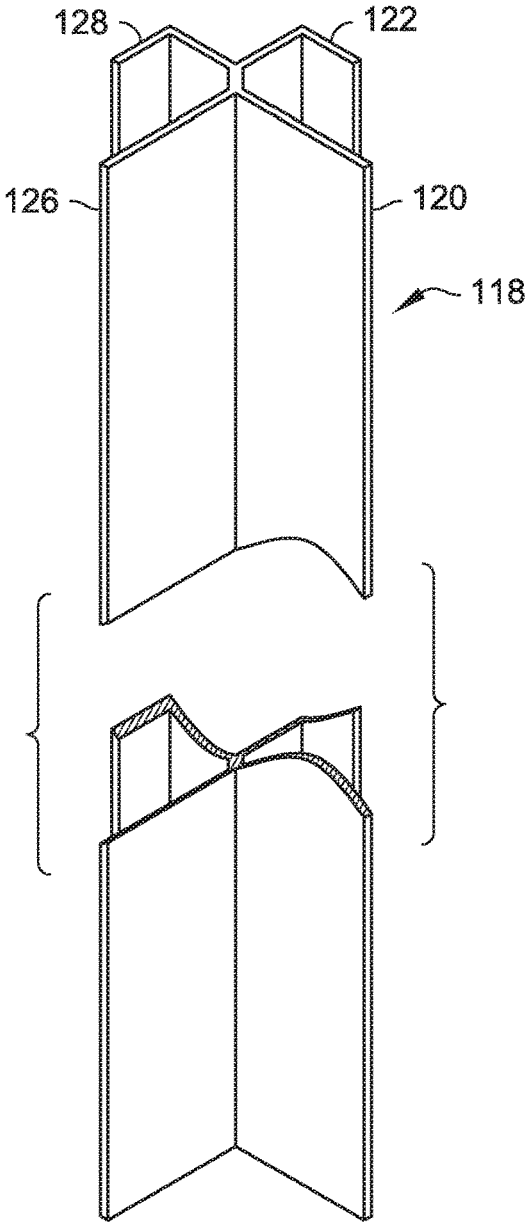
FIG. 3B is a partial isometric view of the outside corner channel extrusion illustrated in FIG. 3A.

Referring generally to FIGS. 1 through 21, systems, apparatus, and techniques for installing siding panels are described. As shown in FIG. 1, a siding panel installation system 100 can be installed on one or more exterior sides of a building. With reference to FIGS. 2A and 2B, a siding panel installation system 100 can include an outside corner clip 102 with an attachment leg 104 and a support channel 106 spaced apart from the attachment leg 104 and offset from a mounting face plane 108 of the attachment leg 104. In some embodiments, an outside corner clip 102 can be formed as an extrusion (e.g., a metal extrusion, such as an aluminum extrusion).

Referring now to FIGS. 5 and 6, the mounting face plane 108 of the attachment leg 104 of the outside corner clip 102 is configured to be placed against an attachment surface 110 of an exterior wall 112 for attachment to the exterior wall 112 via a fastener 114 inserted through the attachment leg 104. For example, an outside corner clip 102 is placed against a wall (e.g., an exterior or outside wall) of a structure (e.g., a commercial and/or residential building) proximate to a corner of the wall. Then, one or more fasteners 114 (e.g., screws) are used to secure the outside corner clip 102 to the wall. Additional outside corner clips 102 may also be placed in line with the first outside corner clip 102, as shown in the accompanying figures. In some embodiments, an outside corner clip 102 can include one or more predrilled apertures or pilot holes 116 (FIGS. 2A and 2B) for receiving a fastener 114.

With reference to FIGS. 3A through 4B, the siding panel installation system 100 can also include an outside corner channel 118 with a first leg 120 configured to be received in the support channel 106 of the outside corner clip 102. In embodiments of the disclosure, the outside corner channel 118 also includes a second leg 122 opposite the first leg 120 to retain a siding panel 124 (FIG. 1) between the first leg 120 and the second leg 122 of the outside corner channel 118 (e.g., at a side of the panel). In some embodiments, an outside corner channel 118 can be formed as an extrusion (e.g., a metal extrusion, such as an aluminum extrusion). The siding panel 124 may be a pre-sized siding panel, such as a two-feet by five-feet (2'×5') fiber cement siding panel. However, fiber cement siding panels are provided by way of example only and are not meant to limit the present disclosure. In other embodiments, a siding panel 124 may be another type of panel, such as a solar panel.

Figure 4A:
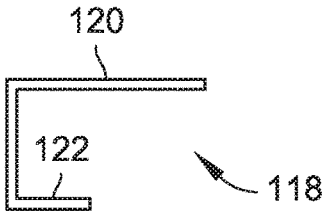
FIG. 4A is an end view illustrating another outside corner channel extrusion in accordance with example embodiments of the present disclosure.
Figure 4B:
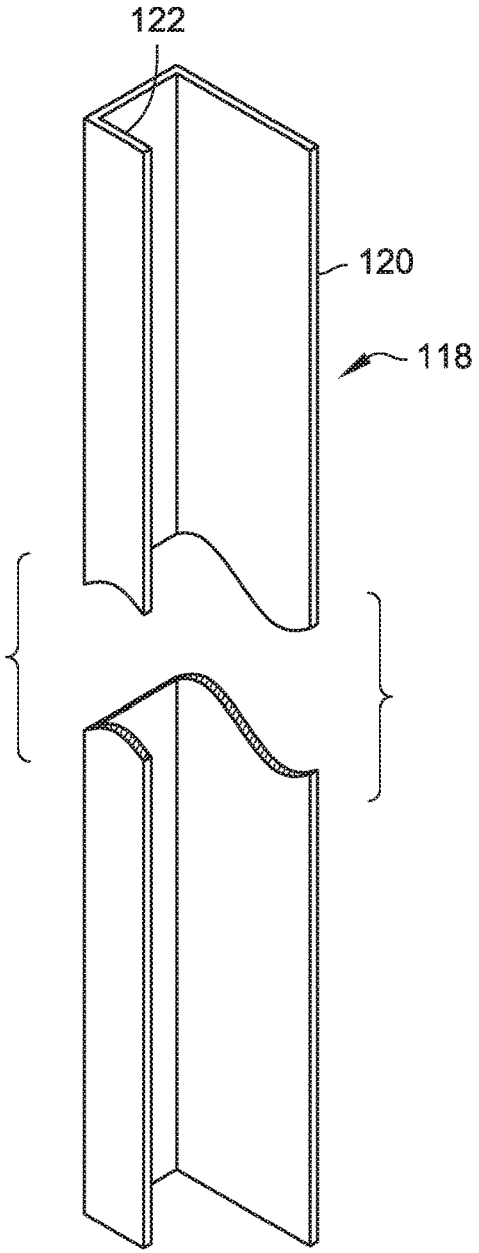
FIG. 4B is a partial isometric view of the outside corner channel extrusion illustrated in FIG. 4A.

In some embodiments, an outside corner channel 118 may be generally J-shaped, as described with reference to FIGS. 4A and 4B. In other embodiments, an outside corner channel 118 may also include a third leg 126 and a fourth leg 128 opposite the third leg 126 to retain another siding panel 124 between the third leg 126 and the fourth leg 128 (e.g., at a side of the second panel). For example, the third leg 126 and the fourth leg 128 can be disposed at least substantially perpendicularly to the first leg 120 and the second leg 122 of the outside corner channel 118, as described with reference to FIGS. 3A and 3B. Referring again to FIGS. 5 and 6, and continuing the example process from above, an outside corner channel 118 is inserted into the support channel 106 of the outside corner clip 102 proximate to the corner of the wall. The outside corner channel 118 can be secured to the outside corner clip 102 using one or more fasteners (e.g., screws, such as self-tapping screws).

With reference to FIGS. 7A through 7C, the siding panel installation system 100 can also include an inside mounting clip 130 with an attachment leg 132 and a support channel 134 spaced apart from the attachment leg 132 and offset from a mounting face plane 136 of the attachment leg 132. In some embodiments, an inside mounting clip 130 can be formed as an extrusion (e.g., a metal extrusion, such as an aluminum extrusion).

Referring now to FIGS. 9 and 10, and continuing the example process from above, the mounting face plane 136 of the attachment leg 132 of the inside mounting clip 130 is configured to be placed against the attachment surface 110 of the exterior wall 112 for attachment to the exterior wall 112 via a fastener 138 inserted through the attachment leg 132. For example, an inside mounting clip 130 is placed against the wall of the building. Then, one or more fasteners 138 (e.g., screws) are used to secure the inside mounting clip 130 to the wall. Additional inside mounting clips 130 may also be placed in line with the first inside mounting clip 130, as shown in the accompanying figures, and may be placed above and/or below an inside mounting clip 130 or a row of inside mounting clips 130. In some embodiments, an inside mounting clip 130 can include one or more predrilled apertures or pilot holes 140 (FIGS. 7A through 7C) for receiving a fastener 138.

Referring again to FIGS. 7A through 7C, in some embodiments an inside mounting clip 130 can include a support tray 142 extending from the support channel 134 for spacing the support channel 134 apart from the attachment surface 110. The support tray 142 may define one or more apertures or holes 144 that allow air and/or liquid (e.g., water, rain) to flow through the support tray 142 as shown in the accompanying figures. As described herein, various apertures, such as the holes 144, defined through the components of the siding panel installation system 100 can promote airflow through the system.

Referring now to FIGS. 8A through 8C, the siding panel installation system 100 can also include a support tray channel 146 with a first leg 148 configured to be received in the support channel 134 of the inside mounting clip 130. In embodiments of the disclosure, the support tray channel 146 also includes a second leg 150 opposite the first leg 148 and offset from a mounting face plane 152 of the first leg 148 by a support tray 154 connecting the first leg 148 and the second leg 150 together. The first leg 148, the second leg 150, and the support tray 154 of the support tray channel 146 are configured to retain and support the siding panel 124 (e.g., at a bottom of the panel). In some embodiments, a support tray channel 146 can be formed as an extrusion (e.g., a metal extrusion, such as an aluminum extrusion).

In some embodiments, a support tray channel may be generally J-shaped (not shown). A support tray channel 146 may also include a third leg 156 opposite the first leg 148, where the third leg 156 of the support tray channel 146 may be offset from the mounting face plane 152 of the first leg 148 (e.g., by a second tray 158 connecting the first leg 148 and the third leg 156 together and/or by the same support tray 154). The first leg 148 and the third leg 156 of the support tray channel 146 can be configured to retain another siding panel 124 (e.g., at a top of the second panel). Referring again to FIGS. 9 and 10, and continuing the example process from above, a support tray channel 146 is inserted into the support channel 134 of the inside mounting clip 130. The support tray channel 146 can be secured to the inside mounting clip 130 using one or more fasteners 160 (e.g., screws, such as self-tapping screws). In some embodiments, the support tray 154 of the support tray channel 146 defines apertures or holes 162 that allow liquid (e.g., water, rain) to drain through the support tray 154 (FIGS. 8A through 8C).

With reference to FIGS. 11A and 11B, the siding panel installation system 100 can also include panel spacers 164 that can be positioned between the siding panel 124 and the support tray channel 146. In embodiments of the disclosure, the panel spacers 164 can be made from compressible, semi-compressible, and/or semi-rigid materials, which can deform to accommodate the various siding panels 124, while still accounting for slightly irregular spacing between the siding panels 124 and the mounting hardware of a siding panel installation system 100 (e.g., clips and channels as described). For example, panel spacers 164 can be constructed from a compressible polymer (e.g., plastic) material. In other embodiments, panel spacers 164 can be constructed from an elastomeric or rubber material. The panel spacers 164 may also have adhesive or other material allowing them to be pressed into place on a panel or other component and held while a panel is being installed. Further, the panel spacers 164 may be used to accommodate expansion and/or contraction of the siding panels 124 and associated mounting hardware (e.g., during different weather conditions and/or seasonally). Referring to FIGS. 12 and 14, and continuing the example process from above, panel spacers 164 are positioned on a side (e.g., a bottom side) of a siding panel 124, and the siding panel 124 and the panel spacers 164 are positioned in the support tray channel 146.

Referring now to FIGS. 13A and 13B, the siding panel installation system 100 can also include a panel spacer channel 166 configured to be received by the support tray channel 146 for spacing apart the siding panel 124 from another siding panel 124 received by the support tray channel 146. In embodiments of the disclosure, the panel spacer channel 166 can include a rear support surface 168 with one or more legs 170 opposite the rear support surface 168 and spaced apart from the rear support surface 168 for retaining the siding panels 124. In some embodiments, a panel spacer channel 166 can be formed as an extrusion (e.g., a metal extrusion, such as an aluminum extrusion). Referring now to FIG. 14, and continuing the example process from above, a panel spacer channel 166 can be placed onto the support tray 154 of the support tray channel 146 between the support channel 134 of the inside mounting clip 130 and the second leg 150 of the support tray channel 146.

With reference to FIGS. 15A and 15B, the siding panel installation system 100 can also include a top panel clip 172 to be positioned between the siding panel 124 and another support opposite the support tray channel 146. In embodiments of the disclosure, the top panel clip 172 can include an attachment leg 174 and a support channel 176 spaced apart from the attachment leg 174 and offset from a mounting face plane 178 of the attachment leg 174. The mounting face plane 178 of the attachment leg 174 of the top panel clip 172 is configured to be placed against an attachment surface 110 of an exterior wall 112 for attachment to the exterior wall 112 via a fastener 180 inserted through the attachment leg 174. In some embodiments, a top panel clip 172 can be formed as an extrusion (e.g., a metal extrusion, such as an aluminum extrusion).

Referring now to FIG. 17, and continuing the example process from above, a top panel clip 172 is placed against the wall above the siding panel 124, and the siding panel 124 is received in the support channel 176 of the top panel clip 172. Then, one or more fasteners 180 (e.g., screws) are used to secure the top panel clip 172 to the wall. Additional top panel clips 172 may also be placed in line with the first top panel clip 172, as shown in the accompanying figures. In some embodiments, a top panel clip 172 can include one or more predrilled apertures or pilot holes 182 for receiving a fastener 180. With reference to FIGS. 16A and 16B, in some embodiments one or more compression strips 184 (e.g., constructed from a foam material, such as weather stripping) can be affixed to the top panel clips 172 to accommodate the various siding panels 124 and account for slightly irregular spacing between the siding panels 124 and the mounting hardware, and/or to accommodate expansion and/or contraction of the siding panels 124 and associated mounting hardware (e.g., as previously described).

With reference to FIG. 18, and continuing the example process from above, in some embodiments another support tray channel 146 may then be placed opposite the first support tray channel 146 (e.g., at a top of the siding panel 124) and secured to another inside mounting clip 130 (e.g., as described with reference to FIGS. 9 and 10). This process can be continued up the attachment surface 110 of the exterior wall 112 until the top of the siding panel installation has been reached.

Referring now to FIGS. 19A through 20B, the siding panel installation system 100 can also include one or more soffit termination channels, such as the back soffit termination channel 186 shown in FIGS. 19A and 19B. In some embodiments, the back soffit termination channel 186 includes a first leg 188 with a generally perpendicularly protruding second leg 190 and third leg 192 that form a channel. The siding panel installation system 100 can also include another soffit termination channel, such as the front soffit termination channel 194 shown in FIGS. 20A and 20B. In some embodiments, the front soffit termination channel 194 includes a first leg 196 configured to be received in the back soffit termination channel 186 and a second leg 198 and third leg 200 offset from the first leg 196. The front soffit termination channel 194 may define one or more apertures or holes 202 that allow air and/or liquid (e.g., water, rain) to flow through the front soffit termination channel 194 as shown in the accompanying figures. With reference to FIG. 21, and continuing the example process from above, at the top of the siding panel installation, another inside mounting clip 130 can be secured to the wall and the first leg 188 of the back soffit termination channel 186 can be inserted into the support channel 134 of the inside mounting clip 130. Then, a front soffit termination channel 194 can be received in the back soffit termination channel 186 and secured to the soffit to retain the top siding panel 124, e.g., using one or more fasteners, such as self-tapping screws.

As described herein, various parts can be formed as extrusions of various lengths. For example, one or more of the outside corner clip 102, the outside corner channel 118, the inside mounting clip 130, the support tray channel 146, the panel spacer channel 166, the top panel clip 172, the back soffit termination channel 186, and/or the front soffit termination channel 194 can be formed as a metal (e.g., aluminum) extrusion.

Although the subject matter has been described in language specific to structural features and/or process operations, it is to be understood that the subject matter defined in the appended claims is not necessarily limited to the specific features or acts described above. Rather, the specific features and acts described above are disclosed as example forms of implementing the claims.

What is claimed is:

1. A siding panel installation system comprising:

an outside corner clip including an attachment leg and a support channel spaced apart from the attachment leg and offset from a mounting face plane of the attachment leg, the mounting face plane of the attachment leg of the outside corner clip to be placed against an attachment surface of an exterior wall for attachment to the exterior wall via a fastener inserted through the attachment leg, the support channel of the outside corner clip configured to receive a first leg of an outside corner channel, the outside corner channel including a second leg opposite the first leg to retain a siding panel between the first leg and the second leg of the outside corner channel;

a support tray channel including a first leg and a second leg opposite the first leg, the second leg of the support tray channel offset from a mounting face plane of the first leg by a support tray connecting the first leg and the second leg together, the first leg, the second leg, and the support tray of the support tray channel configured to retain and support the siding panel; and an inside mounting clip including an attachment leg and a support channel spaced apart from the attachment leg and offset from a mounting face plane of the attachment leg, the mounting face plane of the attachment leg of the inside mounting clip to be placed against the attachment surface of the exterior wall for attachment to the exterior wall via a fastener inserted through the attachment leg, the support channel of the inside mounting clip configured to receive the first leg of the support tray channel, the inside mounting clip including a second support tray extending between the mounting face plane of the attachment leg and the support channel for supporting and spacing apart the support channel from the mounting face plane, the second support tray spaced apart from the attachment leg;

wherein the support tray channel includes a third leg opposite the first leg, the third leg of the support tray channel offset from the mounting face plane of the first leg by a second tray connecting the first leg and the third leg together, the first leg, the third leg, and the second tray of the support tray channel configured to retain and support a second siding panel.

2. The siding panel installation system as recited in claim 1, further comprising the outside corner channel, wherein the outside corner channel includes a third leg and a fourth leg opposite the third leg to retain a second siding panel between the third leg and the fourth leg, the third leg and the fourth leg disposed at least substantially perpendicularly to the first leg and the second leg of the outside corner channel.

3. The siding panel installation system as recited in claim 1, wherein the support tray of the support tray channel defines a plurality of apertures for allowing liquid to drain through the support tray.

4. The siding panel installation system as recited in claim 1, further comprising a panel spacer to be positioned between the siding panel and the support tray channel.

5. The siding panel installation system as recited in claim 1, further comprising a panel spacer channel to be received by the support tray channel for spacing apart the siding panel from a second siding panel received by the support tray channel.

6. The siding panel installation system as recited in claim 1, further comprising a top panel clip to be positioned between the siding panel and another support opposite the support tray channel.

7. A siding panel installation system comprising:

an outside corner clip including an attachment leg and a support channel spaced apart from the attachment leg and offset from a mounting face plane of the attachment leg of the outside corner clip, the mounting face plane of the attachment leg of the outside corner clip to be placed against an attachment surface of an exterior wall for attachment to the exterior wall via a fastener inserted through the attachment leg;

an outside corner channel including a first leg to be received by the support channel of the outside corner clip, the outside corner channel including a second leg opposite the first leg to retain a siding panel between the first leg and the second leg of the outside corner channel;

a support tray channel including a first leg and a second leg opposite the first leg, the second leg of the support tray channel offset from a mounting face plane of the first leg by a support tray connecting the first leg and the second leg together, the first leg, the second leg, and the support tray of the support tray channel configured to retain and support the siding panel; and an inside mounting clip including an attachment leg and a support channel spaced apart from the attachment leg and offset from a mounting face plane of the attachment leg of the inside mounting clip, the mounting face plane of the attachment leg of the inside mounting clip to be placed against the attachment surface of the exterior wall for attachment to the exterior wall via a fastener inserted through the attachment leg, the support channel of the inside mounting clip configured to receive the first leg of the support tray channel, the inside mounting clip including a second support tray extending between the mounting face plane of the attachment leg and the support channel for supporting and spacing apart the support channel from the mounting face plane, the second support tray spaced apart from the attachment leg;

wherein the outside corner channel includes a third leg and a fourth leg opposite the third leg to retain a second siding panel between the third leg and the fourth leg, the third leg and the fourth leg disposed at least substantially perpendicularly to the first leg and the second leg of the outside corner channel.

8. The siding panel installation system as recited in claim 7, wherein the support tray of the support tray channel defines a plurality of apertures for allowing liquid to drain through the support tray.

9. The siding panel installation system as recited in claim 7, wherein the support tray channel includes a third leg opposite the first leg, the third leg of the support tray channel offset from a mounting face plane of the first leg by a second tray connecting the first leg and the third leg together, the first leg, the third leg, and the second tray of the support tray channel configured to retain and support a second siding panel.

10. The siding panel installation system as recited in claim 7, further comprising a panel spacer to be positioned between the siding panel and the support tray channel.

11. The siding panel installation system as recited in claim 7, further comprising a panel spacer channel to be received by the support tray channel for spacing apart the siding panel from a second siding panel received by the support tray channel.

12. The siding panel installation system as recited in claim 7, further comprising a top panel clip to be positioned between the siding panel and another support opposite the support tray channel.

13. A siding panel installation system comprising:

a support tray channel including a first leg and a second leg opposite the first leg, the second leg of the support tray channel offset from a mounting face plane of the first leg by a support tray connecting the first leg and the second leg together, the first leg, the second leg, and the support tray of the support tray channel configured to retain and support a siding panel; and an inside mounting clip including an attachment leg and a support channel spaced apart from the attachment leg and offset from a mounting face plane of the attachment leg, the mounting face plane of the attachment leg of the inside mounting clip to be placed against an attachment surface of an exterior wall for attachment to the exterior wall via a fastener inserted through the attachment leg, the support channel of the inside mounting clip configured to receive the first leg of the support tray channel, the inside mounting clip including a second support tray extending between the mounting face plane of the attachment leg and the support channel for supporting and spacing apart the support channel from the mounting face plane, the second support tray spaced apart from the attachment leg;

wherein the support tray channel includes a third leg opposite the first leg, the third leg of the support tray channel offset from a mounting face plane of the first leg by a second tray connecting the first leg and the third leg together, the first leg, the third leg, and the second tray of the support tray channel configured to retain and support a second siding panel.

14. The siding panel installation system as recited in claim 13, further comprising:

an outside corner clip including an attachment leg and a support channel spaced apart from the attachment leg and offset from a mounting face plane of the attachment leg, the mounting face plane of the attachment leg of the outside corner clip to be placed against the attachment surface of the exterior wall for attachment to the exterior wall via a fastener inserted through the attachment leg; and an outside corner channel including a first leg to be received by the support channel of the outside corner clip, the outside corner channel including a second leg opposite the first leg to retain the siding panel between the first leg and the second leg of the outside corner channel.

15. The siding panel installation system as recited in claim 14, wherein the outside corner channel includes a third leg and a fourth leg opposite the third leg to retain a second siding panel between the third leg and the fourth leg, the third leg and the fourth leg disposed at least substantially perpendicularly to the first leg and the second leg of the outside corner channel.

16. The siding panel installation system as recited in claim 13, wherein the support tray of the support tray channel defines a plurality of apertures for allowing liquid to drain through the support tray.

17. The siding panel installation system as recited in claim 13, further comprising a panel spacer channel to be received by the support tray channel for spacing apart the siding panel from a second siding panel received by the support tray channel.

* * * * *